US009787015B2

(12) United States Patent
Pepe et al.

(10) Patent No.: US 9,787,015 B2
(45) **Date of Patent: *Oct. 10, 2017**

(54) ELECTRICAL CONNECTOR WITH SEPARABLE CONTACTS

(71) Applicant: CommScope Technologies LLC, Hickory, NC (US)

(72) Inventors: Paul John Pepe, Clemmons, NC (US); Steven Richard Bopp, Jamestown, NC (US)

(73) Assignee: COMMSCOPE TECHNOLOGIES LLC, Hickory, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/042,554

(22) Filed: Feb. 12, 2016

(65) Prior Publication Data

US 2017/0025781 A1 Jan. 26, 2017

Related U.S. Application Data

(63) Continuation of application No. 14/139,354, filed on Dec. 23, 2013, now Pat. No. 9,263,821, which is a (Continued)

(51) Int. Cl.
*H01R 13/46* (2006.01)
*H01R 13/02* (2006.01)
(Continued)

(52) U.S. Cl.
CPC ..... *H01R 13/46* (2013.01); *H01R 13/02* (2013.01); *H01R 13/6461* (2013.01); (Continued)

(58) Field of Classification Search
CPC ..... H01R 13/46; H01R 24/64; H01R 13/6461
See application file for complete search history.

(56) References Cited

U.S. PATENT DOCUMENTS 5,299,956 A 4/1994 Brownell et al.
5,310,363 A 5/1994 Brownell et al.
(Continued)

FOREIGN PATENT DOCUMENTS

EP 0901201 3/1999
EP 0940890 9/1999
(Continued)

OTHER PUBLICATIONS

Annex to Form PCT/ISA/206, Communication Relating to the Results of the Partial International Search Report, Int'l Appln. No. PCT/2010/002279, Int'l Filing Date Aug. 19, 2010.
(Continued)

*Primary Examiner* — Ross Gushi
(74) *Attorney, Agent, or Firm* — Merchant & Gould P.C.

(57) ABSTRACT

A contact sub-assembly is provided for an electrical connector. The contact sub-assembly includes a printed circuit and an array of mating contacts. Each mating contact includes a terminating end portion and a mating interface. The contact sub-assembly also includes an array of circuit contacts that is discrete from the array of mating contacts. Each circuit contact is engaged with and electrically connected to the printed circuit. Each circuit contact is separably engaged with and electrically connected to the terminating end portion of a corresponding one of the mating contacts such that the array of circuit contacts electrically connects the array of mating contacts to the printed circuit.

15 Claims, 6 Drawing Sheets

Related U.S. Application Data continuation of application No. 13/948,869, filed on Jul. 23, 2013, now Pat. No. 8,632,368, which is a continuation of application No. 13/651,662, filed on Oct. 15, 2012, now Pat. No. 8,496,501, which is a continuation of application No. 13/164,443, filed on Jun. 20, 2011, now Pat. No. 8,287,316, which is a continuation of application No. 12/547,321, filed on Aug. 25, 2009, now Pat. No. 7,967,644.

(51) Int. Cl.

| | |
|---|---|
| ***H01R 13/66*** | (2006.01) |
| ***H01R 24/64*** | (2011.01) |
| ***H01R 24/00*** | (2011.01) |
| ***H01R 13/6461*** | (2011.01) |
| *H01R 107/00* | (2006.01) |

(52) U.S. Cl.

CPC ..... *H01R 13/6658* (2013.01); *H01R 23/005* (2013.01); *H01R 23/025* (2013.01); *H01R 24/64* (2013.01); *H01R 2107/00* (2013.01)

(56) References Cited

U.S. PATENT DOCUMENTS

| | | | |
|---|---|---|---|
| 5,432,484 | A | 7/1995 | Klas et al. |
| 5,454,738 | A | 10/1995 | Lim et al. |
| 5,470,244 | A | 11/1995 | Lim et al. |
| 5,700,167 | A | 12/1997 | Pharney et al. |
| 5,967,853 | A | 10/1999 | Hashim |
| 5,997,358 | A | 12/1999 | Adriaenssens et al. |
| 6,089,923 | A | 7/2000 | Phommachanh |
| 6,107,578 | A | 8/2000 | Hashim |
| 6,116,964 | A | 9/2000 | Goodrich et al. |
| 6,116,965 | A | 9/2000 | Arnett et al. |
| 6,139,371 | A | 10/2000 | Troutman et al. |
| 6,186,834 | B1 | 2/2001 | Arnett et al. |
| 6,231,397 | B1 | 5/2001 | de la Borbolla et al. |
| 6,270,381 | B1 | 8/2001 | Adriaenssens et al. |
| 6,317,011 | B1 | 11/2001 | Barnett et al. |
| 6,350,158 | B1 | 2/2002 | Arnett et al. |
| 6,443,777 | B1 | 9/2002 | McCurdy et al. |
| 6,464,541 | B1 | 10/2002 | Hashim et al. |
| 6,522,152 | B1 | 2/2003 | Tonti et al. |
| 6,558,207 | B1 | 5/2003 | Pepe et al. |
| 6,840,779 | B2 | 1/2005 | Eberle et al. |
| 6,840,816 | B2 | 1/2005 | Aekins |
| 6,866,548 | B2 | 3/2005 | Hashim |
| 7,025,635 | B2 | 4/2006 | Chang |
| 7,038,554 | B2 | 5/2006 | Seefried |
| 7,074,092 | B1 | 7/2006 | Green et al. |
| 7,140,024 | B2 | 11/2006 | Kaulgud et al. |
| 7,140,924 | B2 | 11/2006 | Redfield et al. |
| 7,153,168 | B2 | 12/2006 | Caveney et al. |
| 7,166,000 | B2 | 1/2007 | Pharney |
| 7,182,649 | B2 | 2/2007 | Caveney et al. |
| 7,190,594 | B2 | 3/2007 | Hashim et al. |
| 7,201,618 | B2 | 4/2007 | Ellis et al. |
| 7,281,957 | B2 | 10/2007 | Caveney |
| 7,294,025 | B1 | 11/2007 | Chen |
| 7,309,261 | B2 | 12/2007 | Caveney et al. |
| 7,314,393 | B2 | 1/2008 | Hashim |
| 7,341,493 | B2 | 3/2008 | Pepe et al. |
| 7,357,683 | B2 | 4/2008 | Caveney et al. |
| 7,364,470 | B2 | 4/2008 | Hashim |
| 7,367,849 | B2 | 5/2008 | Wang et al. |
| 7,381,098 | B2 | 6/2008 | Hammond, Jr. et al. |
| 7,402,085 | B2 | 7/2008 | Hammond, Jr. et al. |
| 7,407,417 | B2 | 8/2008 | Pepe et al. |
| 7,410,367 | B2 | 8/2008 | Hashim et al. |
| 7,442,092 | B2 | 10/2008 | Caveney et al. |
| 7,452,246 | B2 | 11/2008 | Caveney et al. |
| 7,481,678 | B2 | 1/2009 | Aekins |
| 7,481,681 | B2 | 1/2009 | Caveney et al. |
| 7,485,004 | B2 | 2/2009 | Liu et al. |
| 7,544,088 | B2 | 6/2009 | Caveney et al. |
| 7,572,148 | B1 | 8/2009 | Pepe et al. |
| 7,575,482 | B1 | 8/2009 | Pepe et al. |
| 7,628,656 | B2 | 12/2009 | Shields et al. |
| 7,641,521 | B2 | 1/2010 | Pepe et al. |
| 7,658,651 | B2 | 2/2010 | Pepe et al. |
| 7,686,649 | B2 | 3/2010 | Pepe et al. |
| 7,785,154 | B2 | 8/2010 | Peng |
| RE41,699 | E | 9/2010 | Itano et al. |
| 7,794,286 | B2 | 9/2010 | AbuGhazaleh et al. |
| 7,823,281 | B2 | 11/2010 | Caveney et al. |
| 7,824,231 | B2 | 11/2010 | Marti et al. |
| 7,837,513 | B2 | 11/2010 | Millette et al. |
| 7,857,362 | B2 | 12/2010 | Deblock |
| 7,857,635 | B2 | 12/2010 | Goodrich et al. |
| 7,874,879 | B2 | 1/2011 | Caveney et al. |
| 7,914,345 | B2 | 3/2011 | Bopp et al. |
| 7,927,152 | B2 | 4/2011 | Pepe et al. |
| 7,967,644 | B2 | 6/2011 | Pepe et al. |
| 8,016,621 | B2 | 9/2011 | Bopp et al. |
| 8,128,436 | B2 | 3/2012 | Bopp et al. |
| 8,187,040 | B2 | 5/2012 | Pepe et al. |
| 8,282,425 | B2 | 10/2012 | Bopp et al. |
| 8,287,316 | B2 | 10/2012 | Pepe et al. |
| 8,496,501 | B2 * | 7/2013 | Pepe ..... H01R 13/02 439/676 |
| 8,632,368 | B2 | 1/2014 | Pepe et al. |
| 9,263,821 | B2 | 2/2016 | Pepe et al. |
| 2001/0008189 | A1 | 7/2001 | Reede |
| 2001/0014563 | A1 | 8/2001 | Morita et al. |
| 2004/0127105 | A1 | 7/2004 | Itano et al. |
| 2004/0146002 | A1 | 7/2004 | Azadet |
| 2004/0224564 | A1 | 11/2004 | Wan et al. |
| 2005/0026509 | A1 | 2/2005 | Chang |
| 2005/0136747 | A1 | 6/2005 | Caveney et al. |
| 2005/0282442 | A1 | 12/2005 | Hyland et al. |
| 2006/0134992 | A1 | 6/2006 | Green et al. |
| 2007/0015417 | A1 | 1/2007 | Caveney et al. |
| 2007/0117469 | A1 | 5/2007 | Caveney et al. |
| 2007/0123112 | A1 | 5/2007 | Caveney et al. |
| 2007/0212945 | A1 | 9/2007 | Wang et al. |
| 2007/0212946 | A1 | 9/2007 | Bert et al. |
| 2007/0254529 | A1 | 11/2007 | Pepe et al. |
| 2007/0259571 | A1 | 11/2007 | Chen |
| 2007/0293094 | A1 | 12/2007 | Aekins |
| 2008/0045090 | A1 | 2/2008 | Caveney |
| 2008/0171454 | A1 | 7/2008 | Liu et al. |
| 2008/0239937 | A1 | 10/2008 | Erickson et al. |
| 2008/0268710 | A1 | 10/2008 | Hashim et al. |
| 2008/0305680 | A1 | 12/2008 | Little et al. |
| 2008/0305692 | A1 | 12/2008 | Little et al. |
| 2008/0311778 | A1 | 12/2008 | Aekins |
| 2009/0075523 | A1 | 3/2009 | Caveney et al. |
| 2009/0104821 | A1 | 4/2009 | Marti et al. |
| 2009/0258545 | A1 | 10/2009 | Pepe et al. |
| 2009/0269978 | A1 | 10/2009 | Pepe et al. |
| 2009/0305563 | A1 | 12/2009 | Pepe et al. |
| 2009/0318033 | A1 | 12/2009 | Tobey |
| 2010/0041278 | A1 | 2/2010 | Bopp et al. |
| 2010/0151707 | A1 | 6/2010 | AbuGhazaleh et al. |
| 2010/0221956 | A1 | 9/2010 | Pepe et al. |
| 2011/0053428 | A1 | 3/2011 | Pepe |
| 2011/0053430 | A1 | 3/2011 | Bopp et al. |
| 2011/0053431 | A1 | 3/2011 | Bopp et al. |
| 2011/0143605 | A1 | 6/2011 | Pepe |
| 2011/0171858 | A1 | 7/2011 | Pepe et al. |
| 2011/0250802 | A1 | 10/2011 | Pepe et al. |
| 2011/0306250 | A1 | 12/2011 | Bopp et al. |
| 2012/0034822 | A1 | 2/2012 | Bopp et al. |
| 2012/0122352 | A1 | 5/2012 | Caveney |
| 2012/0202389 | A1 | 8/2012 | Erickson et al. |
| 2013/0029536 | A1 | 1/2013 | Bopp et al. |

(56) References Cited

U.S. PATENT DOCUMENTS

| | | | |
|---|---|---|---|
| 2013/0040503 | A1 | 2/2013 | Pepe et al. |
| 2013/0210287 | A1 | 8/2013 | Wu |

FOREIGN PATENT DOCUMENTS

| | | |
|---|---|---|
| EP | 1406354 | 4/2004 |
| EP | 1596478 | 11/2005 |
| GB | 243874 | 12/2007 |
| WO | WO 2007/009020 | 1/2007 |
| WO | WO 2009/131640 | 10/2009 |

OTHER PUBLICATIONS

International Search Report, International Search Report No. PCT/US2010/002285, International Filing Date Aug. 19, 2010.

International Search Report, International Application No. PCT/US2010/002278, International Filing Date Aug. 19, 2010.

* cited by examiner

ELECTRICAL CONNECTOR WITH SEPARABLE CONTACTS

CROSS-REFERENCE TO RELATED APPLICATIONS

The present application is a continuation of U.S. patent application Ser. No. 14/139,354, filed on Dec. 23, 2013, which is a continuation of U.S. patent application Ser. No. 13/948,869 (U.S. Pat. No. 8,632,368), filed on Jul. 23, 2013, which is a continuation of U.S. patent application Ser. No. 13/651,662 (U.S. Pat. No. 8,496,501), filed on Oct. 15, 2012, which is a continuation of U.S. patent application Ser. No. 13/164,443 (U.S. Pat. No. 8,287,316), filed on Jun. 20, 2011, which is a continuation of U.S. patent application Ser. No. 12/547,321 (U.S. Pat. No. 7,967,644), filed on Aug. 25, 2009. Each of the above applications are incorporated by reference in their entirety.

BACKGROUND OF THE INVENTION

The subject matter described and/or illustrated herein relates generally to electrical connectors, and, more particularly, to electrical connectors that include mating contact arrays.

Electrical connectors that are commonly used in telecommunication systems provide an interface between successive runs of cables and/or between cables and electronic devices of the system. Some of such electrical connectors, for example modular jacks, are configured to be joined with a mating plug and include a contact sub-assembly having an array of mating contacts. Each of the mating contacts of the contact sub-assembly extends a length from a terminating end portion to a tip. A mating interface is provided along the length of each mating contact between the terminating end portion and the tip. The mating interface of each mating contact engages a corresponding contact of the mating plug to electrically connect the mating plug to the electrical connector. The contact sub-assembly may also include a plurality of wire terminating contacts that are electrically connected to a cable or electronic device of the system. The wire terminating contacts are electrically connected to the terminating end portions of the mating contacts, for example via a printed circuit, to establish an electrical connection between the mating contacts and the cable or electronic device.

The performance of some electrical connectors, such as modular jacks, may be negatively affected by near-end crosstalk (NEXT) and/or return loss. Specifically, NEXT and/or return loss may be generated along the signal path between adjacent differential pairs of the mating contacts of the electrical connector. For example, NEXT and/or return loss may be generated along the signal path of the electrical connector when the surface area of the contacts of the mating plug is greater than the surface area of the mating contacts of the electrical connector. Moreover, and for example, NEXT and/or return loss may be generated at the interface between the terminating end portions of the mating contacts and the printed circuit.

There exists a need for improving the performance of an electrical connector by reducing crosstalk and/or by improving return loss.

BRIEF DESCRIPTION OF THE INVENTION

In one embodiment, a contact sub-assembly is provided for an electrical connector. The contact sub-assembly includes a printed circuit and an array of mating contacts. Each mating contact includes a terminating end portion and a mating interface. The contact sub-assembly also includes an array of circuit contacts that is discrete from the array of mating contacts. Each circuit contact is engaged with and electrically connected to the printed circuit. Each circuit contact is separably engaged with and electrically connected to the terminating end portion of a corresponding one of the mating contacts such that the array of circuit contacts electrically connects the array of mating contacts to the printed circuit.

In another embodiment, an electrical connector includes a housing and a contact sub-assembly held by the housing. The contact sub-assembly includes a printed circuit and an array of mating contacts. Each mating contact includes a terminating end portion and a mating interface. The contact sub-assembly also includes an array of circuit contacts that is discrete from the array of mating contacts. Each circuit contact is engaged with and electrically connected to the printed circuit. Each circuit contact is separably engaged with and electrically connected to the terminating end portion of a corresponding one of the mating contacts such that the array of circuit contacts electrically connects the array of mating contacts to the printed circuit.

DETAILED DESCRIPTION OF THE INVENTION

Figure 1:
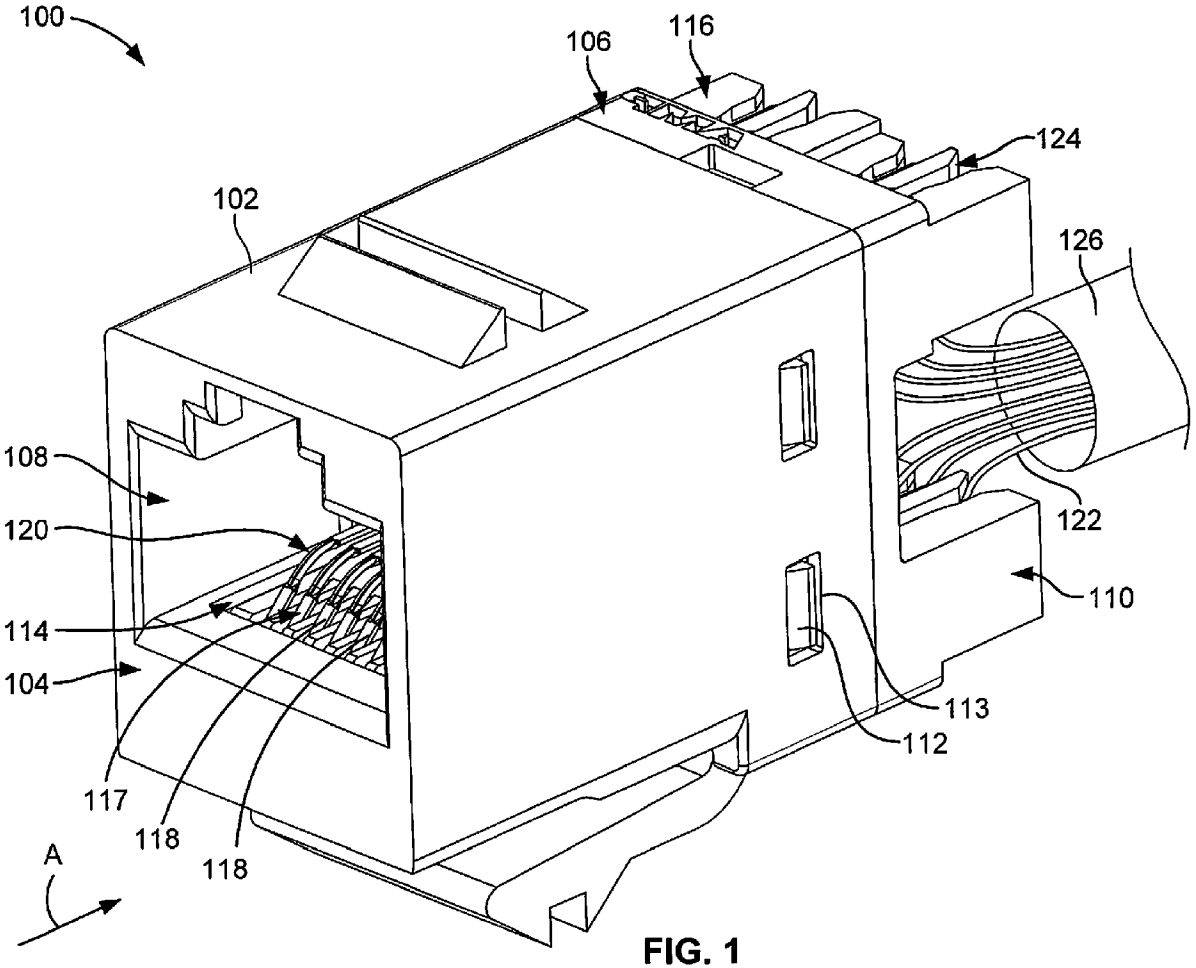
FIG. 1 is a front perspective view of an exemplary embodiment of an electrical connector.

FIG. 1 is a front perspective view of an exemplary embodiment of an electrical connector 100. In the exemplary embodiment, the connector 100 is a modular connector, such as, but not limited to, an RJ-45 outlet or jack. However, the subject matter described and/or illustrated herein is applicable to any other type of electrical connector. The connector 100 is configured for joining with a mating plug (not shown). The mating plug is loaded along a mating direction, shown generally by arrow A. The connector 100 includes a housing 102 extending from a mating end portion 104 to a terminating end portion 106. A cavity 108 extends between the mating end portion 104 and the terminating end portion 106. The cavity 108 receives the mating plug through the mating end portion 104.

The connector 100 includes a contact sub-assembly 110 received within the housing 102 through the terminating end portion 106 of the housing 102. In the exemplary embodiment, the contact sub-assembly 110 is secured to the housing 102 via tabs 112 of the contact sub-assembly 110 that cooperate with corresponding openings 113 within the housing 102. The contact sub-assembly 110 extends from a mating end portion 114 to a terminating end portion 116. The contact sub-assembly 110 is held within the housing 102 such that the mating end portion 114 of the contact sub-assembly 110 is positioned proximate the mating end portion 104 of the housing 102. The terminating end portion 116 extends outward from the terminating end portion 106 of the housing 102. The contact sub-assembly 110 includes an array 117 of a plurality of mating contacts 118. Each mating contact 118 within the array 117 includes a mating interface 120 arranged within the cavity 108. Each mating interface 120 engages a corresponding contact (not shown) of the mating plug when the mating plug is mated with the connector 100. The arrangement of the mating contacts 118 may be controlled by industry standards, such as, but not limited to, International Electrotechnical Commission (IEC) 60603-7. In an exemplary embodiment, the connector 100 includes eight mating contacts 118 arranged as differential pairs. However, the connector 100 may include any number of mating contacts 118, whether or not the mating contacts 118 are arranged in differential pairs.

In the exemplary embodiment, a plurality of communication wires 122 are attached to terminating contacts 124 of the contact sub-assembly 110. The terminating contacts 124 are located at the terminating end portion 116 of the contact sub-assembly 110. As will be described below, each terminating contact 124 is electrically connected to a corresponding one of the mating contacts 118. The wires 122 extend from a cable 126 and are terminated to the terminating contacts 124. Optionally, the terminating contacts 124 include insulation displacement connections (IDCs) for terminating the wires 122 to the contact sub-assembly 110. Alternatively, the wires 122 may be terminated to the contact sub-assembly 110 via a soldered connection, a crimped connection, and/or the like. In the exemplary embodiment, eight wires 122 arranged as differential pairs are terminated to the connector 100. However, any number of wires 122 may be terminated to the connector 100, whether or not the wires 122 are arranged in differential pairs. Each wire 122 is electrically connected to a corresponding one of the mating contacts 118. Accordingly, the connector 100 provides electrical signal, electrical ground, and/or electrical power paths between the mating plug and the wires 122 via the mating contacts 118 and the terminating contacts 124.

Figure 2:
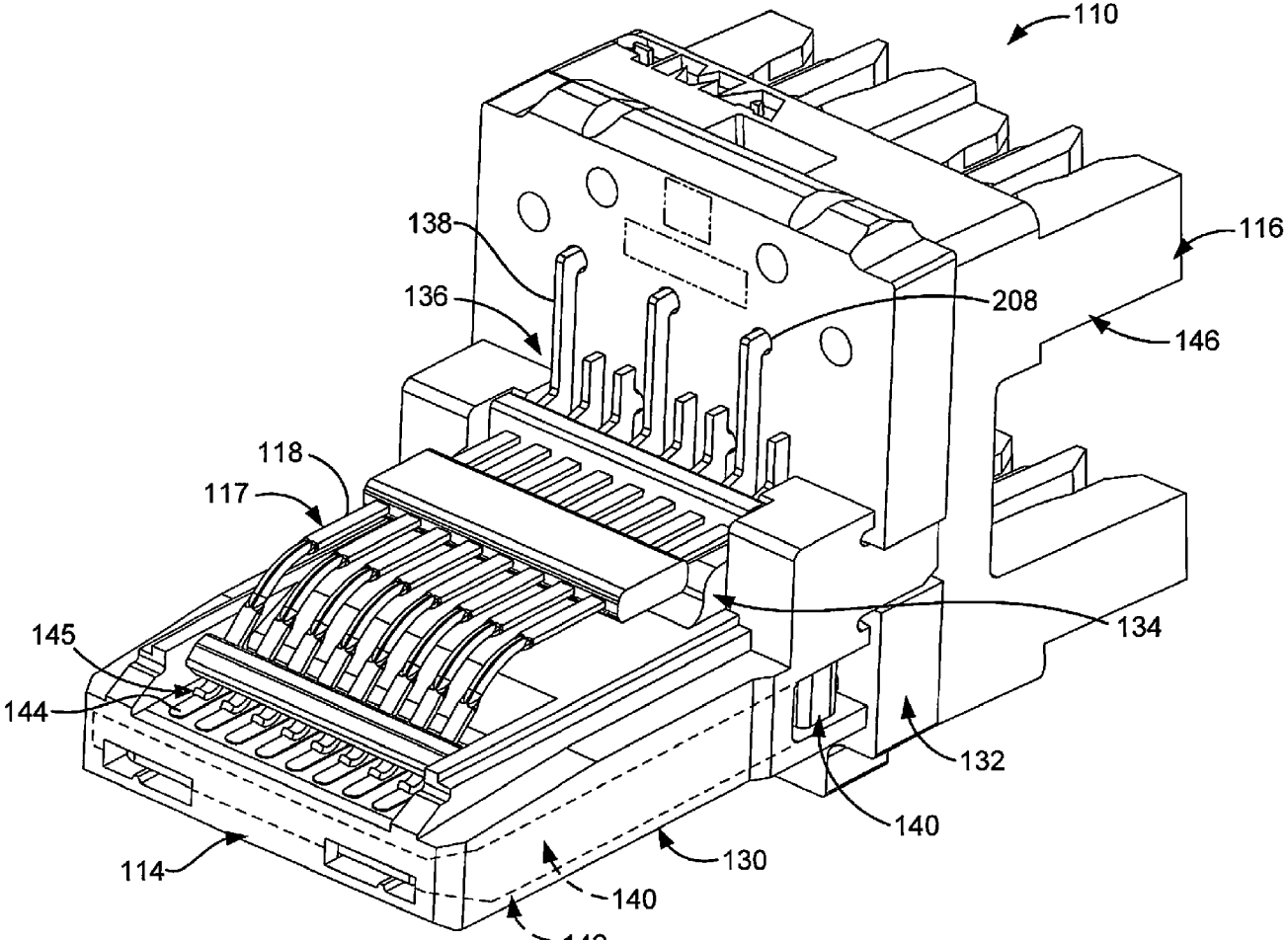
FIG. 2 is a front perspective view of an exemplary embodiment of a contact sub-assembly of the electrical connector shown in FIG. 1.

FIG. 2 is a front perspective view of an exemplary embodiment of the contact sub-assembly 110. The contact sub-assembly 110 includes a base 130 extending from the mating end portion 114 to a printed circuit 132. As used herein, the term "printed circuit" is intended to mean any electric circuit in which the conducting connections have been printed or otherwise deposited in predetermined patterns on a dielectric substrate. The base 130 holds the mating contact array 117 such that the mating contacts 118 extend in a direction that is generally parallel to the loading direction (shown in FIG. 1 by arrow A) of the mating plug (not shown). Optionally, the base 130 includes a supporting block 134 positioned proximate to the printed circuit 132. The contact sub-assembly 110 includes an array 136 of a plurality of circuit contacts 138. The circuit contacts 138 electrically connect the mating contacts 118 to the printed circuit 132. Specifically, each circuit contact 138 is separably engaged with and electrically connected to a corresponding one of the mating contacts 118. The circuit contact array 136 is discrete from the array of mating contacts 118. Specifically, each circuit contact 138 is discrete from the corresponding mating contact 118. As used herein, the term "discrete" is intended to mean constituting a separate part or component. In some embodiments, one or more of the circuit contacts 138 is separately formed from the corresponding mating contact 118. In some embodiments, one or more of the circuit contacts 138 is formed integrally with the corresponding mating contact 118 and is thereafter severed from the mating contact 118. Once severed, the circuit contact 138 is a separate component from the mating contact 118 that may be engaged with and disengaged from the mating contact 118.

The contact sub-assembly 110 also includes the terminating end portion 116, which includes a terminating portion body 146 extending from the printed circuit 132. The terminating portion body 146 includes the terminating contacts 124. The terminating portion body 146 is sized to substantially fill the rear portion of the housing cavity 108 (FIG. 1). Each terminating contact 124 is electrically connected to a corresponding mating contact 118 via the printed circuit 132 and a corresponding one of the circuit contacts 138.

Optionally, the contact sub-assembly 110 includes a printed circuit 140 that is received within a cavity 142 of the base 130. As will be described below, the printed circuit 140 includes a plurality of contact pads 144 that are electrically connected to the printed circuit 132 via corresponding traces 131 (FIG. 6) of the printed circuit 140, corresponding contacts 133*a* and/or 133*b* (FIG. 6) of the printed circuit 140, and/or and the circuit contacts 138. Each trace 131 and contact 133*a* and/or 133*b* of the printed circuit 140 may be on an external and/or an internal layer of the printed circuit 140. When mated with the corresponding contact (not shown) of the mating plug (not shown), a tip end portion 145 of each of the mating contacts 118 is engaged with and electrically connected to a corresponding one of the contact pads 144. The printed circuit 140 may provide a secondary path and/or crosstalk compensation for electrical signals, electrical power, and/or electrical grounds propagating through the contact sub-assembly 110. The printed circuit 132 may be referred to herein as a "first printed circuit", while the printed circuit 140 may be referred to herein as a "second printed circuit".

Figure 3:
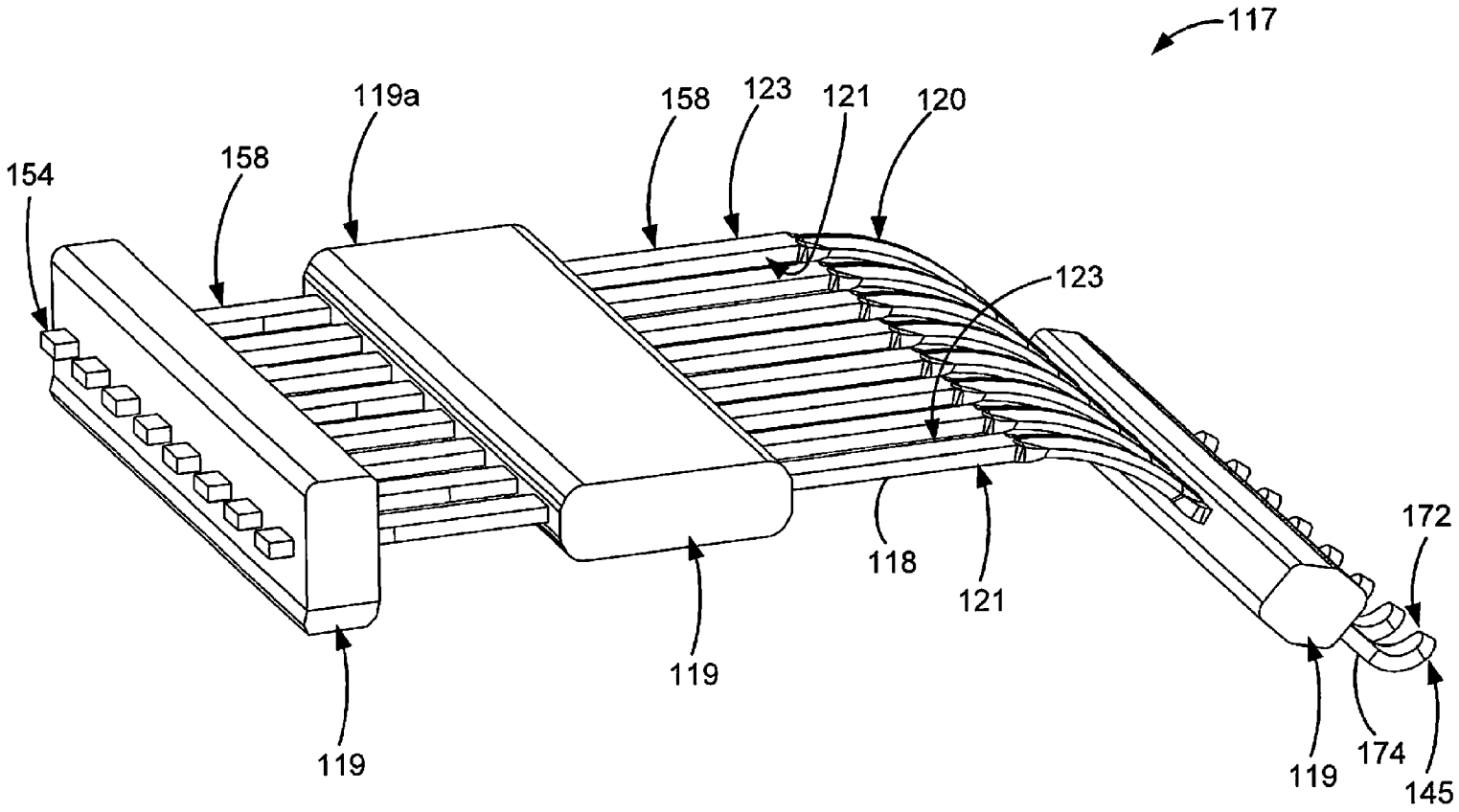
FIG. 3 is a rear perspective view of an exemplary embodiment of an array of mating contacts of the contact sub-assembly shown in FIG. 2.

FIG. 3 is a rear perspective view of an exemplary embodiment of the mating contact array 117. In the exemplary embodiment, the mating contact array 117 includes eight mating contacts 118 arranged as differential contact pairs. However, the mating contact array 117 may include any number of mating contacts 118, whether or not the mating contacts 118 are arranged in differential pairs. The mating contact array 117 optionally includes one or more spacing members 119 that facilitate spacing each mating contact 118 apart from each adjacent mating contact 118 and/or facilitate aligning the mating interfaces 120 for engagement with the contacts (not shown) of the mating plug (not shown).

Each mating contact 118 includes a pair of opposite sides 121 and 123. Each mating contact 118 extends a length from a terminating end portion 154 to the tip end portion 145. The sides 121 and 123 extend from the terminating end portion 154 to the tip end portion 145. An intermediate portion 158 extends between the terminating end portion 154 and the tip end portion 145 of each mating contact 118. As described above, each mating contact 118 includes the mating interface 120, which extends between the intermediate portion 158 and the tip end portion 145. Specifically, the intermediate portion 158 extends from the terminating end portion 154 to the mating interface 120, and the mating interface 120 extends from the intermediate portion 158 to the tip end portion 145.

The terminating end portion 154 of each mating contact 118 engages and electrically connects to a corresponding one of the circuit contacts 138 (FIGS. 2 and 4-6). In the exemplary embodiment, the terminating end portions 154 of the mating contacts 118 are aligned within a common plane. Alternatively, the terminating end portion 154 of one or more of the mating contacts 118 is aligned within a different plane than the terminating end portion(s) 154 of one or more other mating contacts 118.

The intermediate portion 158 of each mating contact 118 extends from the terminating end portion 154 to the mating interface 120. Optionally, the intermediate portion 158 of one or more of the mating contacts 118 includes a cross-over section that crosses over or under the intermediate portion 158 of an adjacent mating contact 118. In the exemplary embodiment, the cross-over sections are covered by one of the spacing members 119*a* such that the cross-over sections are not visible in FIG. 3. Any number of the mating contacts 118 within the contact array 117 may include a cross-over section.

The mating interface 120 of each mating contact 118 extends from the intermediate portion 158 to the tip end portion 145. In the exemplary embodiment, the mating interface 120 is a curved portion. However, the mating interface 120 may have other shapes, such as, but not limited to, straight, angled, and/or the like. The mating interfaces 120 are positioned to engage the contacts of the mating plug when the mating plug is mated with the electrical connector 100 (FIG. 1).

The tip end portion 145 of each mating contact 118 includes a tip 172 and a leg 174. The leg 174 extends from the mating interface 120 to the tip 172. The tip 172 extends outwardly from the leg 174. Optionally, the leg 174 of each mating contact 118 is angled relative to the intermediate portion 158, as can be seen in FIG. 3. In the exemplary embodiment, the tips 172 of each of the mating contacts 118 are aligned along a common plane. Alternatively, the tip 172 of one or ore of the mating contacts 118 is aligned within a different plane than the tip of one or more other mating contacts 118.

Figure 4:
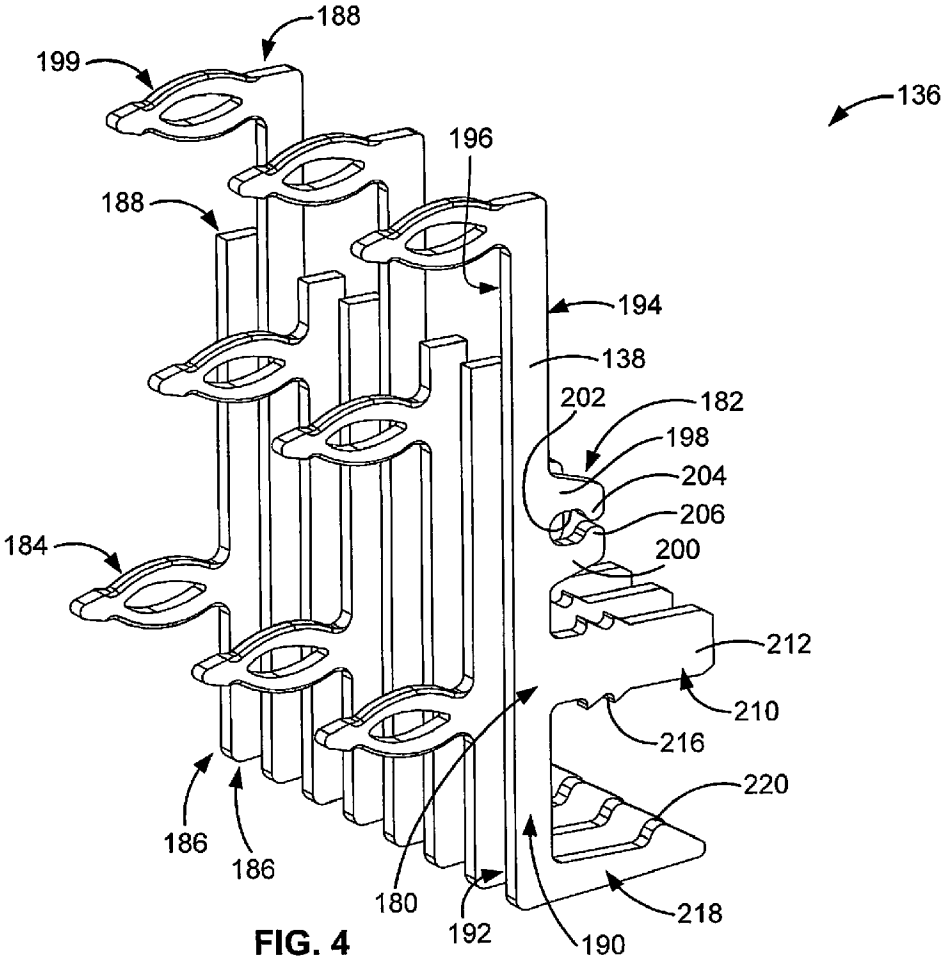
FIG. 4 is a rear perspective view of an exemplary embodiment of an array of circuit contacts of the contact sub-assembly shown in FIG. 2.
Figure 5:
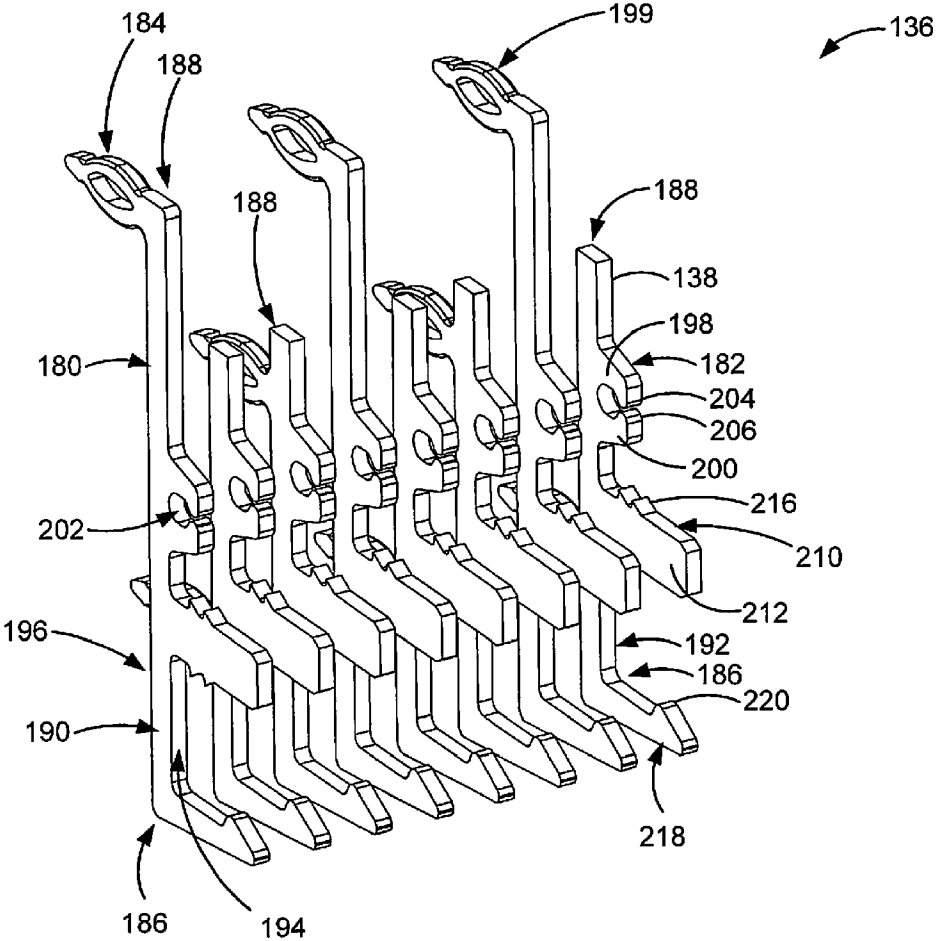
FIG. 5 is a front perspective view of the circuit contact array shown in FIG. 4.
Figure 6:
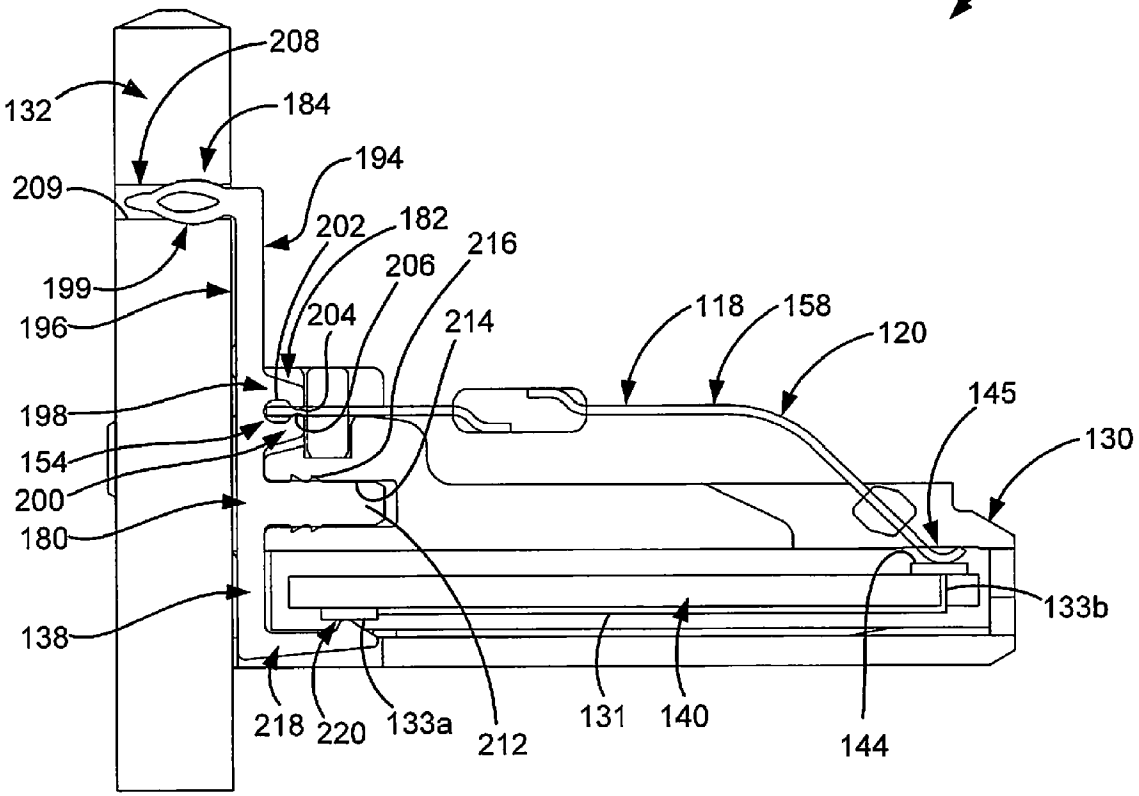
FIG. 6 is a cross-sectional view of a portion of the contact sub-assembly shown in FIG. 2.

FIG. 4 is a rear perspective view of an exemplary embodiment of the circuit contact array 136 of the contact subassembly 110 (FIGS. 1, 2, and 6). FIG. 5 is a front perspective view of the circuit contact array 136. In the exemplary embodiment, the circuit contact array 136 includes eight circuit contacts 138 arranged as differential pairs. However, the circuit contact array 136 may include any number of circuit contacts 138, whether or not the circuit contacts 138 are arranged in differential pairs. Each circuit contact 138 includes a base 180, a mating contact engagement portion 182, and a printed circuit terminating portion 184. Each base 180 extends a length from an end portion 186 to an opposite end portion 188. Each base 180 includes a pair of opposite sides 190 and 192, and a pair of opposite edges 194 and 196. In some embodiments, the surface area of one or more of the circuit contact 138 is greater than the surface area of one or more of the mating contacts 118 (FIGS. 1-3 and 6). For example, in some embodiments, the surface area of the sides 190 and/or 192 of one or more of the circuit contacts 138 is greater than the surface area of the sides 121 and/or 123 (FIG. 3) of the corresponding mating contact 118. The mating contact engagement portion 182 engages the terminating end portion 154 (FIGS. 3 and 6) of the corresponding mating contact 118 such that the mating contact engagement portion 182, and thus the circuit contact 138, is electrically connected to the terminating end portion 154 of the mating contact 118. In the exemplary embodiment, the mating contact engagement portion 182 extends from the edge 194 of the base 180. However, the mating contact engagement portion 182 may extend from any other location on the base 180, such as, but not limited to, the edge 196, the side 190, the side 192, and/or the like.

In the exemplary embodiment, the mating contact engagement portion 182 includes a pair of arms 198 and 200 that define a slot 202 therebetween. The terminating end portion 154 of the corresponding mating contact 118 is configured to be received within the slot 202 such that the terminating end portion 154 is engaged with and held between the arms 198 and 200. Specifically, each arm 198 and 200 includes a respective extension 204 and 206 that engages the terminating end portion 154 of the corresponding mating contact 118 when the terminating end portion 154 is received within the slot 202. In addition or alternatively to the arms 198 and/or 200 and/or the extensions 204 and/or 206, the mating contact engagement portion 182 may include any other structure(s) and/or the like that enables the mating contact engagement portion 182 to engage and electrically connect to the corresponding mating contact 118. In the exemplary embodiment, the mating contact engagement portions 182 of each of the circuit contacts 138 are aligned within a common plane. Alternatively, one or more of the mating contact engagement portions 182 is aligned within a different plane than the mating contact engagement portion 182 of one or more other circuit contacts 138.

The printed circuit terminating portion 184 of each circuit contact 138 engages the printed circuit 132 (FIGS. 2 and 6) such that the printed circuit terminating portion 184, and thus the circuit contact 138, is electrically connected to the printed circuit 132. Although each circuit contact 138 includes only a single printed circuit terminating portion 184, each circuit contact 138 may include any number of printed circuit terminating portions 184. In the exemplary embodiment, the printed circuit terminating portion 184 extends from the edge 196 of the base 180. However, each printed circuit terminating portion 184 may alternatively extend from any other location on the base 180, such as, but not limited to, the edge 194, the side 190, the side 192, and/or the like. Moreover, each printed circuit terminating portion 184 may extend from any location along the length of the corresponding base 180. The number of printed circuit terminating portions 184 and the location of each of the printed circuit terminating portions 184 relative to each other may be selected to provide predetermined electrical performance (such as, but not limited to, crosstalk compensation, return loss, and/or the like).

In the exemplary embodiment, each printed circuit terminating portion 184 includes a press fit contact 199 that is configured to be received within a corresponding via 208 (FIGS. 2 and 6) of the printed circuit 132. The press fit contact 199 of the printed circuit terminating portion 184 is configured to engage an internal wall of the via 208 that has an electrically conductive material 209 (FIG. 6) thereon such that the printed circuit terminating portion 184 is engaged with and electrically connected to the printed circuit 132. In addition or alternatively to the press fit contact 199, the printed circuit terminating portion 184 may include any other structure and/or the like, such as, but not limited to, a surface mount contact, a solder tail contact, and/or the like. In some alternative embodiments, one or more of the printed circuit terminating portion(s) 184 of one or more of the circuit contacts 138 does not engage the printed circuit 132 (which may or may not be included in such an alternative embodiment), but rather is directly engaged with, and thereby directly electrically connected to, the corresponding wire 122 (FIG. 1). In such an embodiment wherein one or more of the printed circuit terminating portion(s) 184 of one or more of the circuit contacts 138 is directly engaged with the corresponding wire 122, the press fit contact 199 may be replaced with any other type of contact for engaging the corresponding wire 22, such as, but not limited to, an insulation displacement contact (IDC), a crimping contact, and/or the like.

In the exemplary embodiment, some of the printed circuit terminating portions 184 are aligned in a different plane than the printed circuit terminating portions 184 of some other circuit contacts 138, while some of the printed circuit terminating portions 184 are aligned in a common plane with the printed circuit terminating portions 184 of some other circuit contacts 138. Alternatively, the printed circuit terminating portions 184 of all of the circuit contacts 138 within the array 136 are aligned within a common plane, or the printed circuit terminating portion 184 of each circuit contact 138 is aligned within a different plane than the printed circuit terminating portion 184 of each other circuit contact 138.

Each circuit contact 138 optionally includes a connection member 210 that facilitates mechanically connecting the circuit contact 138 to the base 130 (FIGS. 2 and 6) of the contact sub-assembly 110. In the exemplary embodiment, the connection member 210 includes an extension 212 that extends from the edge 194 of the base 180. The extension 212 is configured to be received within an opening 214 (FIG. 6) of the contact sub-assembly base 130. The extension 212 includes optional barbs 216 extending outwardly therefrom for engaging portions of the base 130 defining the opening 214 to hold the extension 212 within the opening 214. The extension 212 may alternatively extend from any other location on the circuit contact base 180 besides the edge 194.

Each circuit contact 138 optionally includes an extension 218 that engages and electrically connects to the printed circuit 140 (FIGS. 2 and 6). The extension 218 provides a secondary path for electrical signals, power, and/or grounds propagating through the contact sub-assembly 110. In the exemplary embodiment, the extension 218 extends from the edge 194 of the circuit contact base 180. The extension 218 includes an optional barb 220 extending outwardly therefrom for engaging the printed circuit 140 such that the extension 218, and thus the circuit contact 138, is electrically connected to the printed circuit 140. Alternatively, the extension 218 may extend from any other location on the circuit contact base 180 besides the edge 194.

FIG. 6 is a cross-sectional view of a portion of the contact sub-assembly 110. To facilitate mechanically connecting each circuit contact 138 to the base 130, the extension 212 of each circuit contact 138 is received within the opening 214 of the contact sub-assembly base 130. The barbs 216 of the extension 212 engage interior walls of the base 130 that define the opening 214 to hold the extension therein. In the exemplary embodiment, the contact sub-assembly base 130 includes one opening 214 that receives the extension 212 of each of the circuit contacts 138. However, the contact sub-assembly base 130 may include any number of openings 214 each for receiving the extension 212 of any number of the circuit contacts 138. Each circuit contact 138 is positioned such that the mating contact engagement portion 182 thereof extends from the edge 194 of the circuit contact base 180 in a direction toward the corresponding mating contact 118, while the printed circuit terminating portion 184 thereof extends from the edge 196 of the base in a direction toward the printed circuit 132. The direction that the printed circuit terminating portion 184 extends from the base 180 may be referred to herein as a "first direction", while the direction that the mating contact engagement portion 182 extends from the base 180 may be referred to herein as a "second direction". The terminating end portion 154 of each mating contact 118 is received within the slot 202 of the mating contact engagement portion 182 of the corresponding circuit contact 138. Specifically, the extensions 204 and 206 of the arms 198 and 200, respectively, are engaged with the terminating end portion 154 of the corresponding mating contact 118 such that the mating contact 118 is electrically connected to the circuit contact 138. Each circuit contact 138 is thereby a discrete component from the corresponding mating contact 118 that is separably engaged with the corresponding mating contact 118. In other words, each circuit contact 138 is a separate component from the corresponding mating contact 118 that is releasably engaged (i.e., can be repeatedly engaged therewith and disengaged therefrom) with the corresponding mating contact 118.

The press fit contact 199 of the printed circuit terminating portion 184 of each circuit contact 138 is received within a corresponding via 208 of the printed circuit 132. The press fit contact 199 is engaged with the electrically conductive material 209 on an internal wall of the via 208 (also shown in FIG. 2) such that the circuit contact 138 is electrically connected to the printed circuit 132. Each via 208 of the printed circuit 132 is electrically connected to a corresponding one of the terminating contacts 124 via traces (not shown) and/or contacts (not shown) of the printed circuit 132. Each trace and contact of the printed circuit 132 may be on an external and/or an internal layer of the printed circuit 132.

Each mating contact 118 is thereby electrically connected to a corresponding one of the terminating contacts 124, and thus a corresponding one of the wires 122 (FIG. 1), via the corresponding circuit contact 138 and the printed circuit 132. In the exemplary embodiment, a primary path for electrical signals, electrical power, and/or electrical grounds to propagate from the mating plug (not shown) through the contact sub-assembly 110 is defined along each mating contact 118 from the mating interface 120, through the intermediate portion 158, through the corresponding circuit contact 138, and through the printed circuit 132 to the corresponding terminating contact 124.

Optionally, a secondary path for electrical signals, electrical power, and/or electrical grounds propagating from the mating plug through the contact sub-assembly 110 is also provided. For example, in the exemplary embodiment, the barb 220 of the extension 218 of each circuit contact 138 is engaged with and electrically connected to a corresponding contact 133*a* of the printed circuit 140. The tip end portion 145 of each mating contact 118 is engaged with and electrically connected to the corresponding contact pad 144 of the printed circuit 140. A corresponding contact 133*b* and a corresponding trace 131 electrically connects each contact pad 144 with the corresponding contact 133*a*, such that the tip end portion 145 of each mating contact 118 is electrically connected to the corresponding circuit contact 138 via the printed circuit 140. The secondary path for electrical signals, electrical power, and/or electrical grounds to propagate through the contact sub-assembly 110 is defined from the mating interface 120, through the tip end portion 145, along and/or through the printed circuit 140, through the corresponding circuit contact 138, and through the printed circuit 132 to the corresponding terminating contact 124.

The embodiments described and/or illustrated herein may provide an electrical connector having an improved electrical performance. For example, the embodiments described and/or illustrated herein may provide an electrical connector having an improved electrical performance via reduced crosstalk and/or via improved return loss.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Dimensions, types of materials, orientations of the various components, and the number and positions of the various components described and/or illustrated herein are intended to define parameters of certain embodiments, and are by no means limiting and are merely exemplary embodiments. Many other embodiments and modifications within the spirit and scope of the claims will be apparent to those of skill in the art upon reviewing the description and illustrations. The scope of the subject matter described and/or illustrated herein should therefore be determined with reference to the appended claims, along with the full scope of equivalents to which such claims are entitled. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

While the subject matter described and/or illustrated herein has been described in terms of various specific embodiments, those skilled in the art will recognize that the subject matter described and/or illustrated herein can be practiced with modification within the spirit and scope of the claims.

What is claimed is:

1. A contact sub-assembly for an electrical connector, said contact sub-assembly comprising:

a base;

a first printed circuit extending from the base;

a second printed circuit held by the base;

an array of mating contacts held by the base, each mating contact comprising a terminating end portion and a mating interface; and an array of circuit contacts, each circuit contact being engaged with and electrically connected to the first printed circuit, wherein each circuit contact is separably engaged with and electrically connected to the terminating end portion of a corresponding one of the mating contacts such that the array of circuit contacts electrically connects the array of mating contacts to the first printed circuit.

2. The contact sub-assembly according to claim 1, wherein at least one of the circuit contacts comprises an extension engaged with at least one of an electrical contact or an electrical trace of the second printed circuit such that the at least one circuit contact is electrically connected to the second printed circuit, and wherein the extension defines a portion of a secondary path for electrical energy to propagate through the contact sub-assembly.

3. The contact sub-assembly according to claim 2, wherein the extension comprises at least one barb that is engaged with the at least one of an electrical trace or an electrical contact of the second printed circuit.

4. The contact sub-assembly according to claim 2, wherein the base is a sub-assembly base, each circuit contact comprising a contact base, a printed circuit terminating portion extending from the contact base in a first direction toward the first printed circuit, and a mating contact engagement portion extending from the contact base in a second direction toward the corresponding mating contact, the extension extending outwardly from the contact base of the at least one circuit contact in the second direction.

5. The contact sub-assembly according to claim 2, wherein the base is a sub-assembly base, each circuit contact comprising a contact base having a pair of opposite sides and a pair of opposite edges, the extension of the at least one circuit contact extending outwardly from one of the edges of the contact base.

6. The contact sub-assembly according to claim 1, wherein each mating contact comprises a tip end portion, the mating interface extending between the terminating and tip end portions, the tip end portion of at least one of the mating contacts being engaged with and electrically connected to the second printed circuit.

7. The contact sub-assembly according to claim 1, wherein the mating contacts comprise tip end portions, a primary path for electrical energy to propagate through the contact sub-assembly being defined along a first mating contact from the mating interface, through the terminating end portion, and through the at least one circuit contact to the first printed circuit, a secondary path for electrical energy to propagate through the contact sub-assembly being defined from the mating interface of the first mating contact, through the tip end portion, at least one of along or through the second printed circuit, and through the at least one circuit contact to the first printed circuit.

8. The contact sub-assembly according to claim 1, wherein the electrical connector is an RJ-45 jack.

9. The contact sub-assembly according to claim 1, wherein the array of circuit contacts at least one of reduces crosstalk or improves return loss.

10. The contact sub-assembly according to claim 1, wherein the array of circuit contacts is discrete from the array of mating contacts.

11. The contact sub-assembly according to claim 1, wherein each circuit contact comprises a mating contact engagement portion, the mating contact engagement portion comprising a pair of arms, the terminating end portion of the corresponding mating contact being engaged with and held between the arms.

12. The contact sub-assembly according to claim 1, wherein at least one of the circuit contacts has a greater surface area than at least one of the mating contacts.

13. The contact sub-assembly according to claim 1, wherein the terminating end portions of the mating contacts are aligned within a common plane.

14. The contact sub-assembly according to claim 1, wherein each of the circuit contacts comprises a printed circuit terminating portion that is engaged with and electrically connected to the printed circuit, the printed circuit terminating portions of at least two of the circuit contacts being aligned within different planes.

15. The contact sub-assembly according to claim 1, wherein each circuit contact is separately formed from the corresponding mating contact.

* * * * *